United States Patent [19]

Norman

[11] 3,933,963

[45] Jan. 20, 1976

[54] SPINNING PROCESS

[75] Inventor: John Clark Norman, Wilmington, Del.

[73] Assignee: E. I. Du Pont de Nemours and Company, Wilmington, Del.

[22] Filed: Dec. 13, 1974

[21] Appl. No.: 532,610

[52] U.S. Cl. ..... 264/170; 264/184; 264/211

[51] Int. Cl.[2] ..... D01F 6/00

[58] Field of Search..... 260/78 R, 78 SC; 264/170, 264/184, 211

[56] References Cited

UNITED STATES PATENTS

| | | | |
|---|---|---|---|
| 2,662,837 | 12/1953 | Duncan | 134/38 |
| 2,689,198 | 9/1954 | Judd | 134/130 |
| 2,969,328 | 1/1961 | Ellenson | 252/171 |
| 2,989,798 | 6/1961 | Bannerman | 264/171 |
| 3,078,248 | 2/1963 | Ben | 260/78 R |
| 3,446,890 | 5/1969 | Emery et al. | 264/341 |
| 3,536,766 | 10/1970 | Mogford | 252/171 |
| 3,684,775 | 8/1972 | Blomberg | 260/78 R |
| 3,767,756 | 10/1973 | Blader | 264/184 |
| 3,775,361 | 11/1973 | Jensen | 260/32.6 NA |
| 3,850,888 | 11/1974 | Fitzgerald et al. | 260/78 R |

*Primary Examiner*—Jay H. Woo

[57] ABSTRACT

Amine-ended poly(p-phenylene terephthalamide) gives improved spinning results.

2 Claims, No Drawings

SPINNING PROCESS

BACKGROUND OF THE INVENTION

The spinning of poly(p-phenylene terephthalamide) into high strength fibers is taught in U.S. Pat. No. 3,767,756. The polymer may be prepared for example by the technique described in U.S. Pat. No. 3,850,888. The procedure described in said patent suggests the use of substantially stoichiometric amounts of reactants.

Normally, in order to obtain the highest molecular weight polymer under given conditions, stoichiometric amounts of the monomers are used in the polymerization and the polymer should contain about equal amounts of amine and acid end groups or their derivatives.

SUMMARY OF THE INVENTION

The present invention provides an improvement in the process for the formation of a filamentary structure of poly(p-phenylene terephthalamide) (PPD-T). It is based on the discovery that poly(p-phenylene terephthalamido) with an inherent viscosity of at least 3 and preferably from about 5 to 6 containing at least 90 −[10 (I.V.)] milliequivalents of amine end groups per kg. of polymer gives better spinning performance than polymers lacking such amine end content. It is believed that the improvement is due to the reduction of carboxyl and/or dimethylcarboxamide end groups.

DETAILED DESCRIPTION OF THE EMBODIMENTS

End groups in a condensation polymer such as a polyamide may be (a) amine or carboxyl from unreacted monomer ends, or (b) other end groups derived from monofunctional amine or acid present as impurities or resulting from reaction with a solvent used in the polymerization.

The total number of end groups in a given weight of polymer is inversely proportional to the number average molecular weight (Mn) of the polymer. Thus, a poly(p-phenylene terephthalamide) (PPD-T) with a Mn of ca 20,000 (inherent viscosity of 5.0) has an average of 2 end groups per 20,000 grams [or 100 milliequivalents of end groups per kilogram (meq./kg.) of polymer]. A PPD-T polymer with a Mn of ca 24,000 (inherent viscosity of 6.0) has ca 83 meq. of end groups/kg.

In accordance with the present invention, PPD-T with an inherent viscosity of at least 3 and preferably about 5 to 6 and containing at least 90 −[10 (I.V.)] milliequivalents of amine end groups per kg. of polymer is prepared by using an excess of p-phenylene diamine in the preparation of the polymer. The polymer is isolated from the polymerization mixture and dissolved (preferably about 18 to 20 percent by weight) in concentrated sulfuric acid (preferably from about 96 to 101 percent) to produce the anisotropic spinning dope. Optically anisotropic spin dopes are the subject of U.S. Pat. No. 3,671,542, which teaches how such dopes are prepared. The spin dope prepared from the amine-ended PPD-T of the present invention is spun by the dry-jet wet spinning process described in the aforementioned U.S. Pat. No. 3,767,756. The spinning solution passes through a filter of sintered metal prior to entering the spinneret pack. Improvements are seen in extended filter life, spinneret pack life and spinneret life when the amine-ended polymer is employed as compared to the use of balanced polymer. Less degradation of the polymer while in solution is also noted.

TEST PROCEDURES

Amine End Analysis

Weigh 0.2 g. of dry polymer into a 50 ml. Erlenmeyer flask. Add 10 ml. deionized water, 10 ml. acetone, 0.050 ml. of pure 2,4-dinitrofluorobenzene and stopper loosely. Stir on a magnetic stirrer-hot plate at low heat so the solution refluxes on the flask walls gently for two hours. Add acetone as needed to keep the original liquid level.

Allow the suspended polymer to settle and decant off excess liquid. Add about 25 ml. acetone, suspend the polymer in the liquid and again decant off the liquid. Continue this extraction procedure until the decanted liquid fails to form a color when treated with several drops of 15% NaOH. Dry the remaining polymer in a vacuum oven for one hour at 100°C.

Weigh 0.125 g. dried, treated polymer into a 50 ml. Erlenmeyer flask. Add chips of polytetrafluoroethylene to give a layer ¼–½ inch thick. Pipet 25 ml. of 96% $H_2SO_4$ into the flask, add a magnetic stirring bar and stir for four hours. Inspect the flask to insure that no significant amount of undissolved polymer remains.

Measure the absorbance (A) of the polymer solution at 450 nanometers (nm) in a 1 cm. cell vs. 96% $H_2SO_4$ in a 1 cm. cell as reference with a spectrophotometer (e.g. Beckman Acta-CII).

The amine end group content in meq./kg. of polymer is calculated from the equation:

$$\text{meq./kg.} = \frac{\left(\frac{A}{W} - B\right)(V)(1000)}{(l)(K)}$$

where $W$ is the polymer weight in the solution in grams (0.125)

$B$ is the absorbance/gram of polymer (which has not been treated with 2,4-dinitrofluorobenzene) (0.832 g. $^{-1}$)

$V$ is the volume in ml. of the $H_2SO_4$ in the solution (25 ml.)

$l$ is the cell thickness in cm. (1 cm.) and $K$ is the absorption coefficient determined at 450 nm on the model compound [p-(2,4-dinitrophenyl amino)benzanilide] after 4 hours in 96% $H_2SO_4$. K has a value of $1.69 \times 10^3$ ml./meq. cm.

In addition to free amine end groups, polymers may contain some derivatives of amine end groups that are not measured by the above test. Polymers of I.V. from 5-6 made using hexamethylphosphoramide as a solvent normally contain from ca. 5 to ca. 10 meq./kg. of tetramethylphosphoramide groups $-NHPO[N(CH_3)_2]_2$, as determined by total P analysis.

Free carboxyl groups are determined by titration with a base. The carboxyl end group derivative N,N'-dimethyl carboxamide (primarily from a reaction with the impurity dimethyl amine) is determined by hydrolysis and a Kjeldahl N analysis with correction for any tetramethylphosphoramide groups.

A typical polymer of this invention with an I.V. of 5.2 contains the following end groups.

| | |
|---|---|
| Acid | |
| $-COOH$ | 12.5 meq./kg. |
| $-CON(CH_3)_2$ | 19.0 meq./kg. |
| Amine | |
| $-NH_2$ | 47.0 meq./kg. |
| $-NHPO[N(CH_3)_2]_2$ | 8.0 meq./kg. |

Inherent Viscosity

Inherent viscosity (I.V.) is calculated from the equation:

$$I.V. = \frac{\ln(\eta rel)}{c}$$

where $c$ is the concentration (0.5 gram of polymer in 100 ml. of concentrated sulfuric acid, 95 to 98 percent) and $\eta rel$ is the ratio between the flow times of the polymer solution and the acid as measured at 30°C. in a capillary viscometer.

EXAMPLE 1

Poly(p-phenylene terephthalamide) (PPD-T) is made using the general process of U.S. Pat. No. 3,850,888. A stream of molten terephthaloyl chloride at 90°C. is impinged in a chamber on a stream of a solution (ca. 16°C.) of 6.2 percent by weight of p-phenylene diamine in hexamethylphosphoramide and the mixture dropped into the entrance of a continuous screw mixer jacketed with cooling liquid. The viscous product of the mixer is fed to a second continuous screw mixer with cooling means. The mixture is sheared as it is forwarded through the mixer and a portion of the mixture is backmixed at several points along the mixer.

The polymerization product (a dry crumb-like material containing about 12 percent polymer) is mixed with an aqueous solution of hexamethylphosphoramide in a pug mill. The mixture is neutralized with aqueous NaOH and then ground in mills. The resulting polymer slurry is filtered, washed with water and the polymer dried. The polymers described below were made by this general process.

A. PPD-T polymer of 5.3 inherent viscosity (I.V.) containing 22 meq./kg. of amine end groups is made using essentially stoichiometric amounts of the monomers.

B. PPD-T polymer of 5.3 I.V. containing 48 meq./kg. of amine end groups is made by using 0.5 to 1% excess PPD (p-phenylenediamine).

C. PPD-T polymers are made (three runs) using excess PPD in the range of 0.3 to 0.8 percent with the following results:

| (Sample No.) | Inherent Viscosity | Amine end groups meq./kg. |
|---|---|---|
| 1 | 5.5 | 60 |
| 2 | 5.6 | 52 |
| 3 | 5.8 | 37 |

EXAMPLE 2

This example shows the advantage of using spinning solutions of amine-ended polymer.

Solutions containing about 19% PPD-T are made from PPD-T and $H_2SO_4$ (about 100 percent) by mixing at a maximum temperature of about 100°C. The solutions are then stirred under vacuum and then pumped in sequence to a filter of a sintered metal, a spinning pump, a spinneret pack consisting of a sintered metal felt and a spinneret using the general spinning process of U.S. Pat. No. 3,767,756 to Blades.

The filter is changed when the pressure drop between the inlet and outlet of the filter reaches 700 pounds/inch$^2$ (psi). The spinneret pack is changed for the most part because of solution "dripping" from the spinneret rather than jetting. The spinnerets are changed because of plugged holes or dripping. The process is operated continuously except for interruptions due to changing one of the above components.

Spin A is conducted using a blend of polymers similar to A of Example 1 with an I.V. ranging from 5.0 to 5.6. Spin B is conducted using polymer similar to B of Example 1 (made with excess PPD and containing 50–80 meq./kg. of amine ends) with an I.V. ranging from 5.0 to 5.6. Other conditions of both spins are the same. The following results are obtained:

1. Three times the amount of solution passed through the filter in Spin B as compared with Spin A before the filter had to be changed, i.e., the pressure drop reached 700 psi.

2. The spinneret pack life in Spin B was twice that of Spin A.

3. The average spinneret life in Spin B was 50% greater than that in Spin A.

What is claimed is:

1. In the spinning of an anisotropic spin dope of poly(p-phenylene terephthalamide) in concentrated sulfuric acid wherein the spin dope is passed through a filter and a spinneret pack and extruded, the improvement comprising using a polymer having an inherent viscosity of at least 3 and containing at least 90 −[10 (I.V.)] meq. of amine end groups per kg. of polymer, wherein (I.V.) is the inherent viscosity of the polymer whereby filter and spinneret pack life is extended.

2. The process of claim 1 wherein the polymer inherent viscosity is from 5 to 6.

* * * * *